US005098278A

United States Patent [19]

Brandvold

[11] Patent Number: 5,098,278

[45] Date of Patent: Mar. 24, 1992

[54] CONCRETE FINISHING TOOL

[76] Inventor: Christopher J. Brandvold, 9870 Pioneer Cir., Chanhassen, Minn. 55317

[21] Appl. No.: 688,676

[22] Filed: Apr. 22, 1991

[51] Int. Cl.[5] ..... B28B 1/29

[52] U.S. Cl. ..... 425/458; 15/235.3; 15/235.7; D8/45

[58] Field of Search ..... 425/458; 249/DIG. 6; 15/235.3, 235.4, 235.5, 235.6, 235.7, 235.7; D8/45

[56] References Cited

U.S. PATENT DOCUMENTS

| | | | |
|---|---|---|---|
| 24,892 | 11/1895 | Crafts | 425/458 |
| 515,390 | 3/1894 | Walrath | 15/235.7 |
| 690,839 | 1/1902 | Coyan | 425/458 |
| 967,480 | 8/1910 | Wright | 425/458 |
| 1,198,133 | 9/1916 | Jennings | 15/235.7 |
| 1,490,094 | 4/1924 | Daly | 425/458 |
| 1,520,849 | 12/1924 | Birnbach | 249/DIG. 6 |
| 1,673,941 | 6/1928 | Guarino | 15/235.6 |
| 2,389,397 | 11/1945 | Zimmerman | 249/DIG. 6 |
| 2,616,285 | 1/1952 | Shields | 15/235.7 |
| 2,674,005 | 4/1954 | Simon | 425/458 |
| 2,701,465 | 2/1955 | Johnson et al. | 425/458 |
| 2,902,855 | 9/1959 | Stoll | 425/458 |
| 3,608,944 | 9/1971 | Turner | 15/235.3 |
| 3,638,273 | 2/1972 | Haivala | 15/235.4 |
| 3,744,079 | 7/1973 | Krause | 425/458 |
| 3,846,060 | 11/1974 | Otis | 425/458 |
| 4,230,441 | 10/1980 | Heronema | 425/458 |
| 4,669,970 | 6/1987 | Perry | 425/458 |
| 4,915,610 | 4/1990 | Curry | 425/458 |

FOREIGN PATENT DOCUMENTS

| | | | |
|---|---|---|---|
| 91335 | 6/1959 | Netherlands | 249/DIG. 6 |
| 26404 | 2/1909 | Sweden | 15/235.3 |
| 12736 | of 1884 | United Kingdom | 15/235.3 |

OTHER PUBLICATIONS

Frederick Tool Corp. advertisement.

*Primary Examiner*—Jay H. Woo
*Assistant Examiner*—W. J. Matney, Jr.
*Attorney, Agent, or Firm*—Schroeder & Siegfried

[57] ABSTRACT

A vertical-edge concrete-finishing tool having an elongated concrete former of small generally right triangular cross-sectional shape the hypotenuse side of which is a concave forming-surface extending longitudinally of the former and the legs of which are flat and intersect opposite the bottom of the concavity of said forming-surface. A shank member extends upwardly from one end of the former in supporting relation, and a handle member extends upwardly from the upper end of the shank member in supporting relation thereto.

15 Claims, 2 Drawing Sheets

CONCRETE FINISHING TOOL

BACKGROUND OF THE INVENTION

There is a definite need for a method and/or device for providing a desired radius to vertical edges of various concrete constructions, such as concrete steps, etc. The conventional way of constructing concrete steps is to first build a wooden form in the shape and to the dimensions of the desired step construction. Into such a form the concrete is poured while still in soft condition, the concrete taking the shape of the form's interior which is the desired shape, and thereby defining the step construction.

As the concrete commences to set and harden, the horizontal upper edges thereof are radiused with conventional tools, while the vertical edges thereof are relatively inaccessible because of the presence of the surrounding wooden form. If any joints are to be formed in the top surface of the concrete slab within the form, such are induced in the upper surface of the slab as it hardens. The horizontal edges of the concrete slab are radiused with a conventional radiusing tool just prior to the hardening of the concrete slab.

Once the slab has hardened sufficiently to maintain its desired form, the wooden form can be removed. It is at this point that the wooden form is conventionally removed and thereafter the attempts to radius the vertical edges are conventionally made.

At this point, the concrete is necessarily fairly well hardened and it is difficult, if not virtually impossible to radius all of the vertical edges before they have reached a degree of hardness such that they are not longer readily formable. This is particularly true, when difficulty is experienced with one of the vertical edges because of a rock or other form of aggregate being located at the very edge which requires removal or repair work immediately adjacent thereto. By the time such repair work on one of the edges is completed, the other vertical edges are frequently hardened to a condition which make their proper repair or forming impossible. As a consequence, radiusing of the vertical edges such as those formed in the pouring of a concrete slab and steps, is a difficult and reoccurring problem which makes it difficult, time-consuming, and expensive to overcome, and often results in an unsatisfactory and ill-appearing edge.

My invention is designed to overcome this problem and to solve it in a practical, inexpensive, and superior manner, so that the resultant product is superior in construction and appearance and is less expensive and time-consuming as compared to those formed through the use of conventional methods and radiusing devices.

My new former or edger tool obviates the problem frequently experienced when the concrete at several vertical edges becomes too hard to be properly shaped, while one of the other vertical edges is being properly radiused or repaired. Some stones and concrete sometimes come loose while a vertical edge is being worked upon, thereby requiring additional time for repair, with the adverse result that the concrete defining the remaining vertical edges hardens beyond favorable conditions for needed additional shaping. When this occurs, the resulting vertical edges are unsightly and unstable and, therefore, highly undesirable.

BRIEF SUMMARY OF THE INVENTION

My new edger tool is constructed so that it can be used in a practical manner to radius vertical edges of a step while the form is still in place, and while the concrete is still in a sufficiently soft and shapeable form, so as to cause the concrete to shape to the desired form. The tool in cross-section is of generally right triangular shape, and is elongated so that it can be inserted downwardly into the corner of the form which defines the vertical edge of the step. Since the tool is elongated and has two flat intersecting legs which define a right angle, it can be inserted into the corner of the form with the two legs bearing against the two boards of the form which constitute the corners of the form. It also has an elongated concave forming-surface which extends between said legs along the hypotenuse of the right triangular shape of the tool. By working the tool upwardly and downwardly gently, it can be caused to proceed to the lower end of the vertical edge and its concave forming-surface can be caused to radius the vertical edge of the step while the form remains in place. When this operation has been accomplished in each corner of the form which defines a vertical edge of a step, the form can be permitted to remain in place until the entire slab and steps have hardened to such an extent that the form can be renewed without concern that the concrete faces may shift or otherwise alter their shape.

We have found that if this tool is applied and manipulated as described when the concrete has reached the appropriate degree of firmness, a well-defined, attractive, and strong radiused surface will be produced at each of the vertical edges of the steps. A substantial amount of time and effort are thereby conserved and the resultant product is much stronger and better-appearing then when formed in the conventional manner as heretofore utilized.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 6:
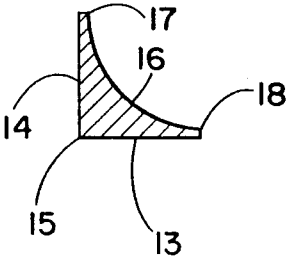
FIG. 6 is a cross-sectional view of one of my tools having a $\frac{3}{4}''$ radius.
Figure 5:
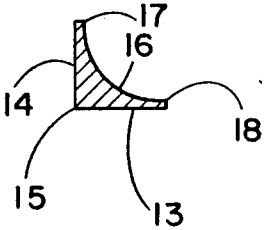
FIG. 5 is a cross-sectional view of one of my tools having a $\frac{1}{2}''$ radius.
Figure 4:
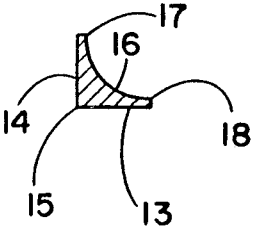
FIG. 4 is a cross-sectional view of one of my tools having a $\frac{3}{8}''$ radius.

As shown in FIGS. 1–6 inclusive, my new concrete finishing tool may comprise a handle member 10 supporting a shank member 11 which extends forwardly and downwardly therefrom and terminates in an elongated at least semi-rigid straight former 12 which extends forwardly and at an angle of approximately 110° therefrom. The concrete former 12 is preferably approximately sixteen (16) inches long and is of generally right triangular cross-sectional shape, as best shown in FIGS. 4–6, inclusive. The former may be made of metal, plastic, or any other rigid material. It will be seen that shank member 11 extends upwardly and rearwardly from the former 12 at approximately 110°, and that handle 10 extends upwardly and rearwardly from shank member 11 at an angle of approximately 50°.

As shown in FIGS. 4–6, the former 12 has a pair of side legs 13 and 14 which intersect, as at 15, to define the right angle at the lower edge of the former. Directly opposite the right angle defined by legs 13 and 14 is a concave forming-surface 16 which extends along the hypotenuse of the right triangle and terminates just short of the legs 13 and 14, as at 17 and 18. It will be seen that this concave forming-surface 16 extends throughout the length of the former 12, and the bottom of its concavity is directly opposite line 15. Also, it is longer than each of said legs 13 an 14. It will also be seen that the concave surface 16 terminates just short of each of the legs 13 and 14, thereby defining edges **16*a* and 16*b*** which extend parallel to each other and extend throughout the length of said concave surface.

Figure 1:
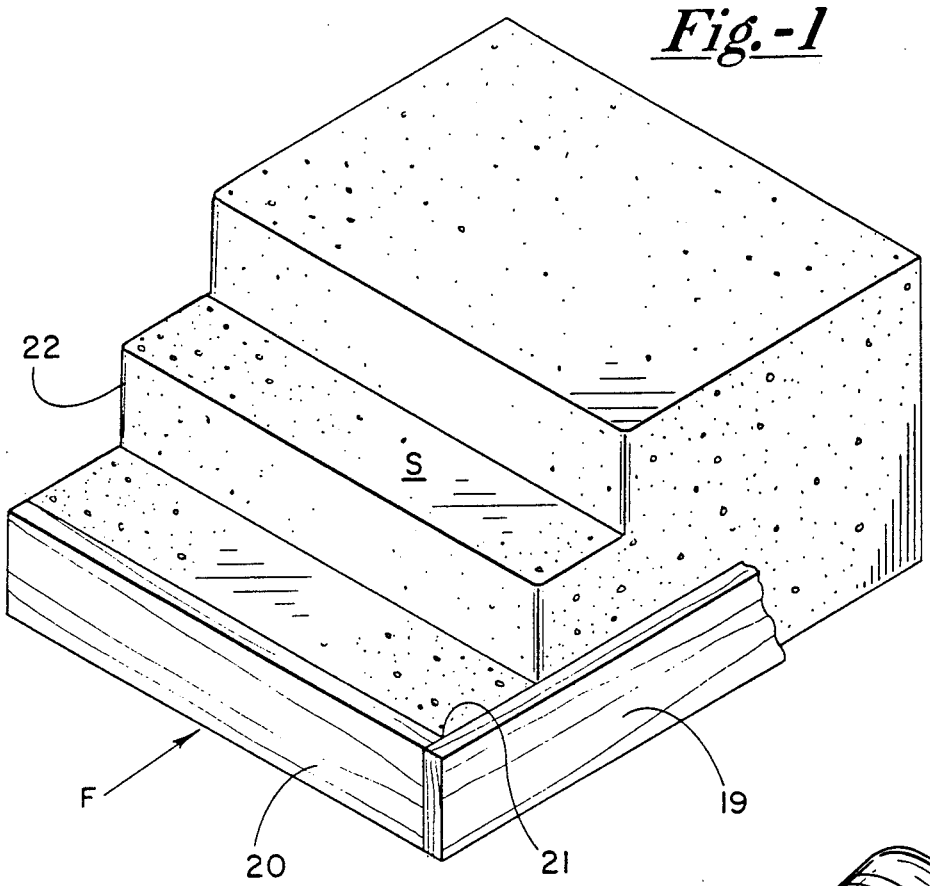
FIG. 1 of the drawings herein is a perspective view of a set of concrete steps partially encased with a standard type form to assist in the understanding of the problems overcome and the manner in which my tool is utilized.
Figure 2:
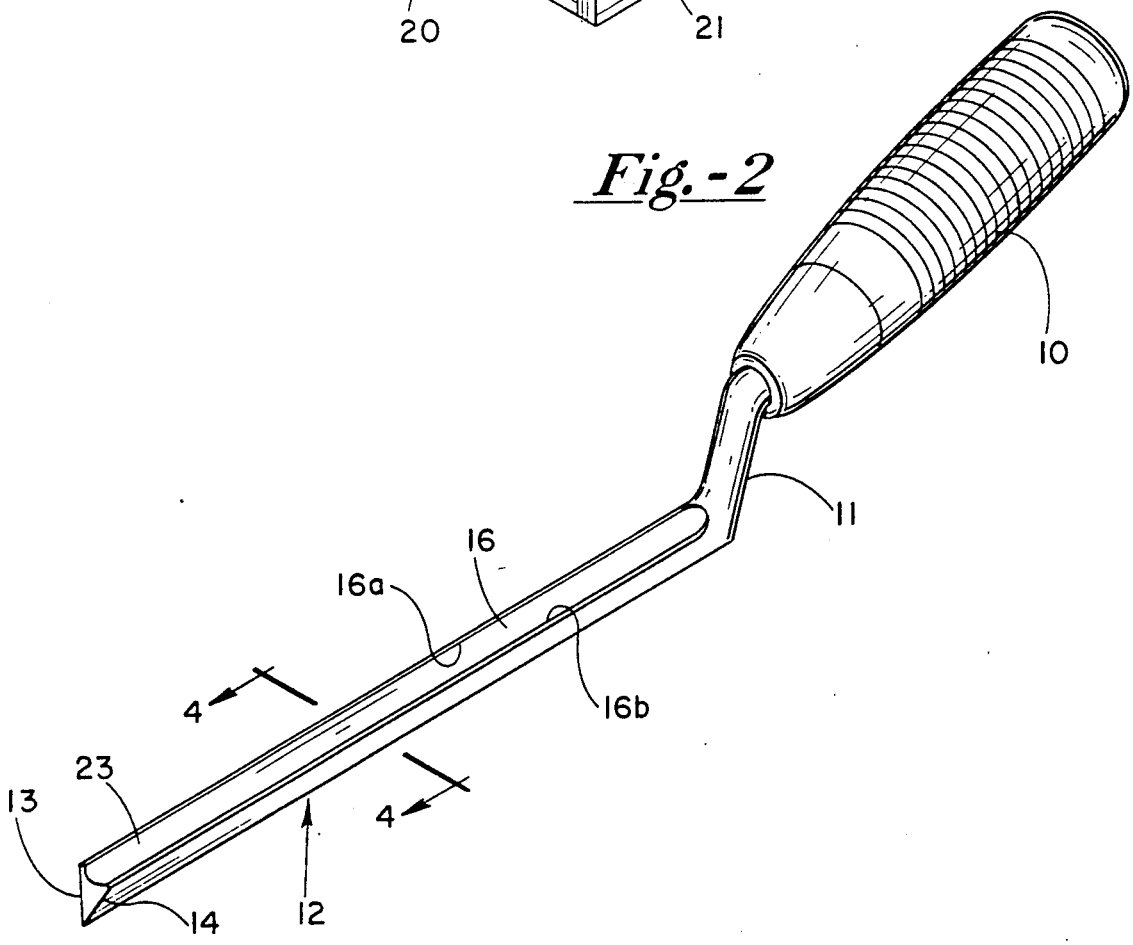
FIG. 2 is a perspective view of one of my new tools.
Figure 3:
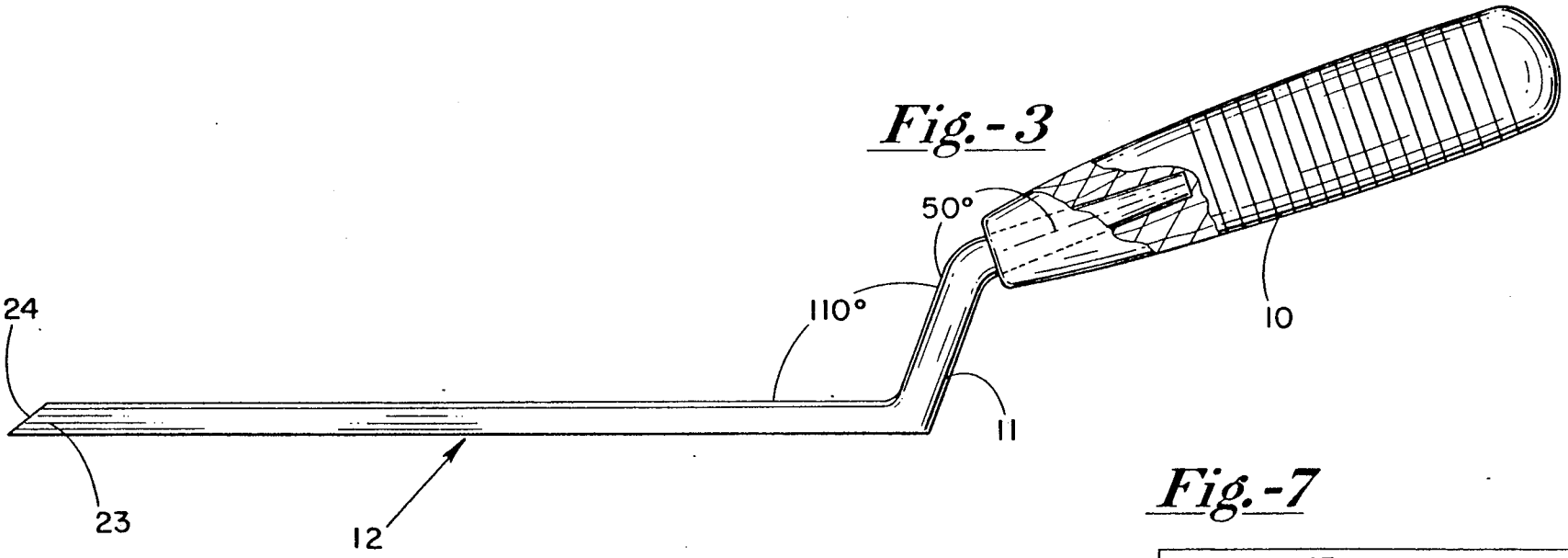
FIG. 3 is a side elevational view of my new tool.

FIG. 1 shows a set of steps with all but the lower portion of the form F removed. This lower portion includes a panel 19 secured at right angles to a second panel 20 to define a corner at 21 at which the vertical edge of the step is formed. This vertical edge is similar in construction and appearance to the vertical edge 22 shown at the lower left of FIG. 1, the form having been removed therefrom.

Figure 7:
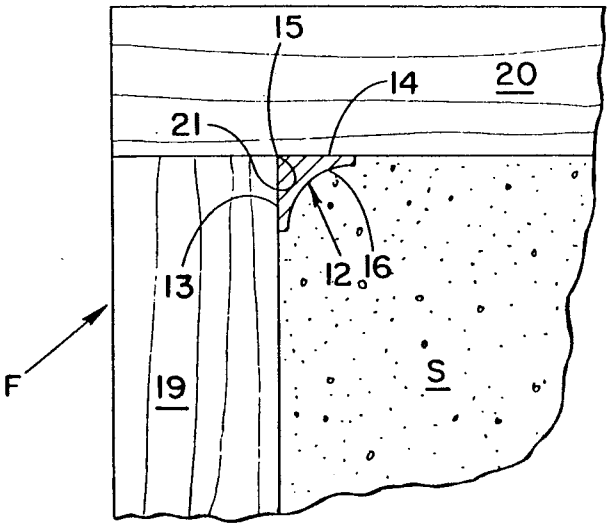
FIG. 7 is a fragmentary horizontal sectional view taken through the corner of a cement step with the form intact and one of my edger tools inserted along the corner in vertical-edge shaping position.

In use, my tool is utilized by inserting, from above, its forward end 23 at the inside of the upper end of the corner formed at 21 by the two panels 19 and 20. FIG. 7 shows the tool 12 as it progresses along the corner at 21 and as it shapes the vertical edge at the corner of the step 5. This is accomplished only after the concrete has hardened sufficiently so as to retain its form once it has been shaped, but will not seriously resist shaping. It is applied so that the flat leg 13 will bear against panel 19 and the other leg 14 will bear against panel 20, the juncture 15 of the two legs extending into the inside corner at 21.

The workman applying my tool while grasping its handle, in the manner described, can effect its entry without seriously disturbing the concrete by reciprocating the tool gently in a vertical direction. The forward end 23 of the former 12 is beveled as at 24 to facilitate its entry, as described. As the former 12 descends, the shapeable concrete is formed or shaped along the vertical edge of the step originally defined by the panels 19 and 20 at 21, so as to have a radius equal to that of the concave forming-surface 16. As described in the description of the drawings, the forming-surface 16 preferably has a concavity within the range of $\frac{3}{8}''$–$\frac{3}{4}''$. Upon reaching the lower end of the vertical edge, the former is withdrawn and the radiused vertical edge is permitted to set, while retaining its radiused shape.

As described, my tool is used to shape the radius into the vertical edges of concrete steps while the form F is still in place. Conventional tools and methods heretofore known do not allow this shaping until the forms are removed. After the forms are removed, the concrete is hard and almost impossible to shape.

With my tool, it may be inserted and worked between the form and the partially hardened concrete while the form F remains in place. When the form is removed, the vertical edges will retain their radiused shape. By using my above tool, the concrete finishing process is speeded up substantially, while the amount of physical labor which is required is substantially reduced. Moreover, a better finished product is obtained in that it is better appearing, stronger, and will last longer without serious deterioration.

It will, of course, be understood that various changes may be made in the form, details, arrangement and proportions of the parts without departing from the scope of the invention which consists of the manner shown and described herein and set forth in the appended claims.

What is claimed is:

1. A concrete finishing tool comprising:

(a) an elongated straight vertical edge former;

(b) a shank member connected to and supporting said former and extending at an angle therefrom;

(c) a handle member connected to said shank member in supporting relation thereto;

(d) said former being of smaller generally right triangular shape in cross-section and having side legs which extend at a right angle to each other and are connected along a straight line;

(e) said legs having flat exterior surfaces;

(f) said former having an elongated concave forming-surface extending lengthwise thereof between said legs and along the hypotenuse side of said right triangularly shaped former; and (g) said concave forming-surface in cross-section having a radius of concavity.

2. The structure defined in claim 1, wherein said concave forming-surface has a radius of concavity between $\frac{3}{8}$ inch and $\frac{3}{4}$ inch.

3. The structure defined in claim 1, wherein said concave forming-surface has a radius of approximately one-half ($\frac{1}{2}$) inch.

4. The structure defined in claim 1, wherein said concave forming-surface has a radius of approximately three eighths ($\frac{3}{8}$) inch.

5. The structure defined in claim 1, wherein said concave forming-surface has a radius of approximately three fourths ($\frac{3}{4}$) inch.

6. The structure defined in claim 1, wherein said shank member extends upwardly from said former and said concave forming-surface faces upwardly toward said shank member.

7. The structure defined in claim 1, wherein said right triangularly shaped former has a pair of exterior leg surfaces extending at right angles to each other, and wherein said concave forming-surface extends between said terminates slightly short of said leg surfaces.

8. The structure defined in claim 1, wherein said right triangularly shaped former has a pair of exterior leg surfaces extending at right angles to each other and said concave forming-surface has a pair of longitudinally extending edges each of which is disposed closely adjacent to but just short of one of said leg surfaces.

9. The structure defined in claim 1, wherein said shank member extends upwardly and obliquely from said former.

10. The structure defined in claim 1, wherein said shank member extends upwardly and obliquely from said former and said handle member extends upwardly and acutely from said shank member.

11. The structure defined in claim 1, wherein said shank member extends upwardly from said former at an angle of approximately 110°.

12. The structure defined in claim 1, wherein said handle member extends upwardly from said shank member at an angle of approximately 50°.

13. The structure defined in claim 1, wherein said right triangularly shaped former has a pair of exterior leg surfaces extending at right angles to each other and meeting along a line disposed directly opposite the bottom of the concavity of said forming-surface.

14. The structure defined in claim 1, wherein said former has a beveled forward end to facilitate the insertion of said former along a cornerline of a concrete form.

15. The structure defined in claim 1, wherein each of said legs is shorter than said concave forming-surface

* * * * *

UNITED STATES PATENT AND TRADEMARK OFFICE

CERTIFICATE OF CORRECTION

PATENT NO. : 5,098,278

DATED : Mar. 24, 1992

INVENTOR(S) : Christopher J. Brandvold

It is certified that error appears in the above-identified patent and that said Letters Patent is hereby corrected as shown below:

Column 1, line 35 change "not" to --no--.

Column 2, line 27 change "renewed" to --removed--.

Column 4, line 55, change "said" to --and--.

Signed and Sealed this

First Day of June, 1993

*Attest:*

*Attesting Officer*

Michael K. Kirk

MICHAEL K. KIRK

*Acting Commissioner of Patents and Trademarks*